US008298474B2

(12) United States Patent
Kühn et al.

(10) Patent No.: US 8,298,474 B2
(45) Date of Patent: Oct. 30, 2012

(54) DEVICE AND METHOD FOR LOADING AND UNLOADING A HEAT TREATMENT FURNACE

(75) Inventors: Friedhelm Kühn, Mülheim an der Ruhr (DE); Horst Barth, Oberhausen (DE); Wolfgang Schalberger, Dortmund (DE)

(73) Assignee: LOI Thermprocess GmbH, Essen (DE)

( * ) Notice: Subject to any disclaimer, the term of this patent is extended or adjusted under 35 U.S.C. 154(b) by 365 days.

(21) Appl. No.: 12/597,069

(22) PCT Filed: Nov. 28, 2008

(86) PCT No.: PCT/EP2008/066472

§ 371 (c)(1),
(2), (4) Date: Oct. 22, 2009

(87) PCT Pub. No.: WO2009/100791

PCT Pub. Date: Aug. 20, 2009

(65) Prior Publication Data

US 2010/0143080 A1 Jun. 10, 2010

(30) Foreign Application Priority Data

Jan. 14, 2008 (DE) ..... 10 2008 000 056

(51) Int. Cl.
*C21D 1/63* (2006.01)

(52) U.S. Cl. ..... 266/132; 266/114; 266/133; 148/549; 414/626; 414/806

(58) Field of Classification Search ..... 148/549; 266/114, 132, 133; 414/626, 806
See application file for complete search history.

(56) References Cited

U.S. PATENT DOCUMENTS 3,484,085 A * 12/1969 Montagino ..... 266/132
(Continued)

FOREIGN PATENT DOCUMENTS

DE 3004175 8/1981
(Continued)

OTHER PUBLICATIONS

International Search Report of PCT/EP2008/066472 dated Jan. 14, 2008.

*Primary Examiner* — Scott Lowe
(74) *Attorney, Agent, or Firm* — Rankin, Hill & Clark LLP

(57) ABSTRACT

The invention relates to a device for loading and unloading a heat treatment furnace and to a corresponding method. Heat treatment furnaces are normally loaded and unloaded by means of a so-called elevator. During unloading, a removed workpiece is usually lowered by means of the elevator into an oil bath, in which it is then removed from the elevator. Oil is then transferred into the furnace chamber via the oil-covered elevator. Such an application of oil is avoided by means of a device comprising a frame rack having a first and a second level, which are disposed parallel above each other, and are connected to each other by means of a plurality of frame braces, wherein the first and the second levels have a plurality of openings and the frame braces have guide means. The device further comprises a plurality of lifting braces that are connected by a lifting mechanism and are supported vertically movably in the guide means, wherein each lifting brace has carriers at a first and a second position, wherein the carriers are aligned on the lifting braces such that they can be moved in the associated levels in or through the openings upon a vertical movement of the lifting braces. The device further comprises a retaining means disposed on a frame brace, which limits the vertical movement of the corresponding lifting brace.

11 Claims, 6 Drawing Sheets

U.S. PATENT DOCUMENTS

| | | | | |
|---|---|---|---|---|
| 3,684,263 | A * | 8/1972 | Genrich | 266/132 |
| 5,151,006 | A * | 9/1992 | Marttila et al. | 414/626 |
| 5,660,777 | A | 8/1997 | Herrmann et al. | |
| 6,174,123 | B1 * | 1/2001 | Marttila | 414/626 |
| 7,677,860 | B2 * | 3/2010 | Kivisto et al. | 414/626 |
| 2005/0103407 | A1 * | 5/2005 | Masuda et al. | 148/549 |

FOREIGN PATENT DOCUMENTS

| | | |
|---|---|---|
| DE | 19919738 | 8/2000 |
| EP | 0093060 | 11/1983 |
| JP | 2005220410 | 8/2005 |
| JP | 06287630 | 10/2009 |
| WO | 03/081156 | 10/2003 |

* cited by examiner

DEVICE AND METHOD FOR LOADING AND UNLOADING A HEAT TREATMENT FURNACE

1. FIELD OF THE INVENTION

The present invention relates to an apparatus for loading and unloading a heat treatment furnace, particularly a rotary hearth furnace, and to a corresponding method. The present invention relates further to the use of an apparatus with a frame structure with a first upper and a second lower support surface, which are arranged parallel above one another and are connected together by a plurality of struts, for the purpose of loading and unloading a heat treatment furnace.

2. DESCRIPTION OF THE PRIOR ART

Rotary hearth furnaces are commonly loaded and unloaded in accordance with the prior art by means of a so-called elevator. For the purpose of loading, a workpiece is firstly moved onto the positioning-sliding surface of the elevator, normally with a suitable pushing device. The workpiece is then pushed, also with a pushing device, into the rotary hearth furnace via an opening in its outer wall. Depending on the construction of the rotary hearth furnace and of the elevator and further devices used for loading and unloading, the same or a different pushing device can be used for this purpose. For the purpose of unloading, a workpiece is pushed, after the heat treatment in the rotary hearth furnace, with a pushing device, which is situated outside the inner wall of the rotary hearth furnace, out of the furnace and onto the positioning-sliding surface of the elevator. The positioning-sliding surface is then lowered into an oil bath together with the workpiece resting on it to quench the workpiece. In this lower position of the elevator, the workpiece is pushed off the positioning-sliding surface with a further pushing device. The positioning-sliding surface of the elevator is raised out of the oil bath into the position for loading and a further workpiece is pushed onto the positioning-sliding surface in order subsequently to be moved into the rotary hearth furnace. Since the positioning-sliding surface of the elevator is immersed in the oil bath in every unloading process, it is constantly wetted with oil, which, when workpieces are slid from the positioning-sliding surface, moves with them into the rotary hearth furnace. As a result of the temperature prevailing therein, the oil carried in with the workpieces vaporises or burns and contaminates the atmosphere in the rotary hearth furnace. In order to achieve a constantly high quality in the heat treatment process, it is important that such contamination of the atmosphere is avoided.

It is therefore the object of the present invention to provide an apparatus and a method, with which the entry of oil into a heat treatment furnace, while it is being filled, can be avoided.

SUMMARY OF THE INVENTION

This object is solved by an apparatus in accordance with the invention.

The apparatus in accordance with the invention for loading and unloading a heat treatment furnace, particularly a rotary hearth furnace, includes a frame structure with a first upper and a second lower plane, which are arranged parallel above one another and are connected together by means of a plurality of frame struts, wherein the first and second planes each have a plurality of openings and wherein the frame struts have a plurality of guide means.

The apparatus further includes a plurality of lifting struts, which are connected to a lifting mechanism and are vertically movably mounted in the guide means of the frame struts and extend vertically above the upper plane, wherein each lifting strut has a carrier at a first position associated with the first plane and at a second position associated with the second plane. The carriers are so aligned on the lifting struts that, when vertical movement of the lifting struts occurs, they are movable into or through the openings in the associated planes. The apparatus further includes at least one stop means arranged on a frame strut, which limits the vertical movement of the corresponding lifting strut.

The invention is based on the idea of using a "double decker" apparatus for loading and unloading a heat treatment furnace, wherein, in addition to a frame structure which includes the first and second planes, this apparatus includes a further lifting frame constituted by the lifting struts, and wherein the lifting struts have a plurality of carriers. The carriers and the planes constitute a support surface, which, depending on the position of the lifting struts in the frame structure, is so constructed on the one hand that workpieces can merely rest on the plane or can be slid onto it or can be pushed off it but on the other hand only the carriers constitute the support surface for the workpieces, whereby it is then possible that a raising/lowering manipulator engages beneath the workpieces which can thus be transported into or out of the rotary hearth furnace.

For the purpose of loading and unloading the heat treatment furnace, different planes or support surfaces are used. Whilst the upper plane or surface is always used for loading the rotary hearth furnace, the lower plane is always used for unloading. During loading of the rotary hearth furnace, oil is thus prevented from being carried over into it.

As a result of the use of the carriers, which are arranged on the lifting struts, it is also possible not to push the workpieces for the purpose of loading and unloading but to move them with a lifting/lowering manipulator into or out of the rotary hearth furnace. For this purpose, the manipulator engages beneath the workpieces and lifts them slightly for the appropriate manipulation. Such engagement beneath the workpieces is only possible if they are lifted from the planes by the carriers so that a space is created for appropriate lifting means of the manipulator. Such a loading and unloading process is particularly advantageous because so-called track bricks in the rotary hearth furnace, on which the workpieces are slid with conventional loading and unloading apparatus into and out of the rotary hearth furnace, can be omitted. These track bricks can be manufactured with constant quality only with extreme difficulty and must be replaced in a cost and time intensive manner within relatively short time periods.

The frame structure of the apparatus is so constructed that workpieces can be moved without difficulty onto or from the corresponding planes or carriers. The term "workpiece" in this application includes not only individual workpieces, which are moved without a grating, but also a number of workpieces on so-called gratings, whereby the workpieces are then always moved together with the gratings.

Depending on the application, the frame structure can have three or more frame struts, by means of which the two planes are connected together. It is also possible to connect two frame struts together in certain sections by means of a wall, if this should be necessary, for instance for reasons of stability or for the purpose of thermal radiation insulation.

The frame struts have a plurality of guide means, in which the lifting struts are guided. The number of guide means used per frame strut is primarily dependent on the size of the apparatus and the weight of the workpieces to be moved.

Mounted in the guide means are vertically movable lifting struts, which are connected to a lifting mechanism. All the lifting struts can be connected to a separate lifting mechanism or a plurality of lifting struts are connected together and connected to the same lifting mechanism. For instance, each two struts can be connected to a lifting mechanism so that it is possible to raise or lower the lifting struts to a different extent. The lifting struts constitute a "lifting frame", which is movable with respect to the frame structure. The lifting struts can be so constructed that they are arranged "within" the frame structure, whereby in this event the planes have further openings or adapted openings, since the lifting struts are guided in such a case at least partially through the planes. The lifting struts can, however, also be guided by the guide means "outside" the frame structure. In such a case, the lifting struts move outside the frame structure but the carriers move in or through the planes. The openings in the planes are always so constructed that either they can receive the carriers or that the carriers can move through them. In such a case, the openings naturally extend through the entire height of the planes.

Whether the carriers move during corresponding vertical movement through or merely into the planes is dependent on the construction of the apparatus. This can be so constructed that the carriers merely move into the planes. In such a case, it should be ensured that the upper surface of the carriers terminates substantially flush with the surface of the planes so that, if desired, workpieces can be slid onto or from the planes.

Arranged on at least one frame strut is a stop means, which limits the vertical movement of the corresponding lifting strut. If only one stop means is used, all the lifting struts are connected together so that the stop means limits the vertical movement of all the lifting struts. If the lifting struts are not all connected together, a correspondingly larger number of stop means must be provided.

The apparatus in accordance with the invention can be adapted to any desired type of heat, treatment furnace. It is particularly suitable for rotary hearth furnaces because in these one opening in a rotary hearth furnace is commonly used both for the loading process and also the unloading process.

In a preferred embodiment of the apparatus in accordance with the invention, slide tracks are arranged on the upper surface of at least one of the planes. These simplify the movement of the workpieces onto or from the planes so that correspondingly smaller pushing devices can be used. The use of the slide tracks also has the advantage that when wear phenomena occur only the slide tracks need to be renewed and the plane itself need not be replaced.

When the lower plane dips into the oil of the quenching bath, the oil flows past the edges of the plane. In order to simplify the introduction of the plane into the oil, the lower plane has a plurality of additional openings, through which the oil can pass when the lower plane is introduced into the oil. In this manner, the quenching bath can on the one hand be made smaller since one is no longer reliant on the oil flowing past the lower plane and on the other hand the introduction of the lower plane into the oil can be accelerated since additional flow openings for the oil are provided.

In order to limit the vertical movement of the lifting struts with respect to the frame structure, at least one stop means is arranged on one of the frame struts. In a preferred embodiment of the apparatus in accordance with the invention, one of the guide means is constructed as the stop means. No separate stop means thus need to be provided which overall simplifies the construction of the apparatus.

The object is further solved by a method in accordance with the invention.

In the method in accordance with the invention, the apparatus is firstly lifted in a step a) into a first position by means of the lifting struts. During this movement into the first position, the at least one stop means limits the vertical movement of the lifting struts with respect to the frame structure. The entire apparatus is thus lifted merely by means of the lifting struts and the frame structure is not directly connected to the lifting mechanism. In this first position, the lower carriers are located above the lower plane and the first workpiece is moved out of the heat treatment furnace onto the lower carriers. The workpiece can, for instance, be gripped from the exterior and placed on the carriers. A further possibility for the movement out of the heat treatment furnace onto the carriers is described below.

After the first workpiece has been placed on the lower carriers, the apparatus is lowered in a step b) by means of the lifting struts so far into a second position that the lower section of the apparatus, which includes the lower carriers and the lower plane, moves into the quenching device and the lower plane is positioned in the quenching device, whereby the carriers, however, remain above the respective plane. Since the carriers remain above the planes, the workpiece still rests on the carriers in this position.

In a step c), a second workpiece is then moved onto an upper support surface, constituted by the upper plane or the upper carriers. This can, for instance, occur such that a manipulator laterally engages a workpiece at a storage or preparation station and deposits it on the upper carriers. A detailed description of this process follows below.

The second workpiece is then moved (step d)) from the upper support surface into the heat treatment furnace. This can, for instance, again occur such that a manipulator laterally engages the workpiece and lifts it into the heat treatment furnace.

After the second workpiece has been moved from the upper support surface into the heat treatment furnace, the lifting struts are lowered further in step e) into a third position such that the carriers move into the planes and the first workpiece is positioned by the lower carriers on the lower plane.

In the event that the apparatus is so constructed that the carriers move through the openings in the planes and not merely into them, spacer means are arranged in the quenching device, on which the lower plane rests at this time, whereby a free space is defined beneath the plane, into which the carriers on the lifting struts can move.

The first workpiece is then removed in step f) from the lower plane with a suitable device.

In step a), the workpiece is preferably engaged from below in the heat treatment furnace by a lifting/lowering manipulator and placed on the lower carriers.

In step c), the workpiece can be engaged, for instance laterally, by a manipulator and placed on the upper carriers. It is, however, preferred that in step c) the workpiece is deposited on the upper carriers with a lifting/lowering manipulator, whereby the manipulator engages beneath the workpiece whilst being transported to the carriers. Such transport of the workpiece is significantly simpler and more reliable—no special holding means need be present on the workpieces which enable them to be laterally gripped. Furthermore, the manipulator need have no gripping functionality but merely lifting means, which engage below the workpiece during the actual transport process.

In a preferred embodiment of the method in accordance with the invention, the workpiece is engaged from below in step d) by a lifting/lowering manipulator and lifted into the heat treatment furnace. The advantages with respect to lateral engagement by a manipulator are those discussed above.

The workpiece is preferably removed in step f) from the lower plane with a pushing or pulling device since these are structurally simple, which is of importance, particularly in d).

In accordance with the method described above, the apparatus is lowered in step b) such that the carriers still remain above the respective plane and the second workpiece is then moved onto the upper support surface, constituted in this case by the upper carriers. Since the carriers are arranged together with the second workpiece above the plane at the time the apparatus is loaded, the second workpiece can only be deposited on the upper carriers from above, for instance with a lifting/lowering manipulator.

In a preferred embodiment of the method in accordance with the invention, the lifting struts are therefore lowered further in accordance with step b) such that the carriers are moved into the openings in the planes, whereby the first workpiece is positioned by the lower carriers on the lower plane. In step c), a second workpiece is then moved with a pushing or pulling device onto the second support surface, as a result of the further lowering of the apparatus constituted by the upper plane, and the apparatus is then lifted by means of the lifting struts such that the carriers lift the workpieces from the respective planes.

This embodiment includes a further method step but this step makes it possible for workpieces to be able to be pushed or pulled onto the upper support surface, constituted in this case by the upper plane. The pushing/pulling of the workpieces into the thermal treatment furnace is undesirable due to the disadvantages referred to above but the pushing/pulling of the workpieces outside the heat treatment furnace is unproblematic due to the very different conditions and circumstances. A pushing or pulling device usable for pushing and pulling the workpieces onto the upper plane is structurally simpler and more economical.

If only a small quenching period is necessary, step f) can be performed at this time with such a conduct of the method, i.e. a workpiece on the lower plane is moved from the lower plane at this time.

The invention relates further to the use of an apparatus with a frame structure with a first upper and a second lower support surface, which are arranged parallel above one another and are connected together by means of a plurality of struts, for loading and unloading a heat treatment furnace, wherein, when unloading the heat treatment furnace, workpieces are moved out of the heat treatment furnace onto the lower support surface and, when loading the heat treatment furnace, workpieces are moved from the upper support surface into the heat treatment furnace.

An exemplary embodiment of the apparatus in accordance with the invention and an exemplary embodiment of the method in accordance with the invention will be described below in more detail with reference to the drawings.

DESCRIPTION OF THE PREFERRED EMBODIMENT

Figure 1:
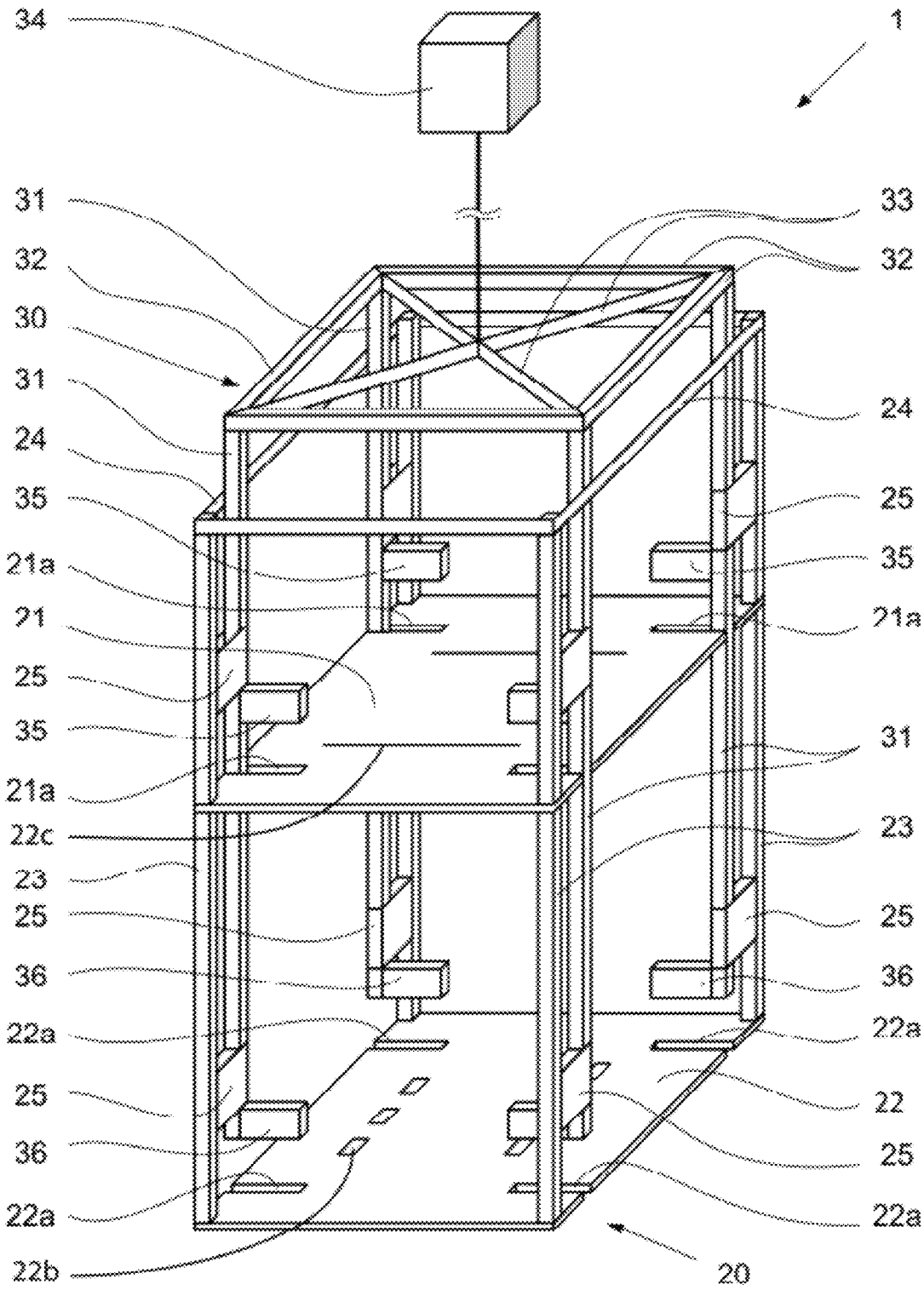
FIG. 1 is a schematic view, of an exemplary embodiment of the apparatus in accordance with the invention.

FIG. 1 is a schematic view of an exemplary embodiment of the apparatus in accordance with the invention. The illustrated apparatus is used for loading and unloading a rotary hearth furnace (not shown).

The apparatus (1) includes a frame structure (20) and a lifting frame (30). The frame structure (20) includes an upper plane (21) and a lower plane (22) parallel to the upper plane, the planes being connected together by means of four frame struts (23) in such a manner that the frame struts (23) extend through or are secured to the corners of the planes (21, 22). The frame struts (23) extend vertically above the upper plane (21) and, in the illustrated exemplary embodiment, are connected together at their upper ends with transverse connectors (24). Such transverse connectors (24) are, however, not absolutely necessary in other exemplary embodiments but they generally increase the stability of the frame structure (20). The upper plane (21) comprises two slide tracks (22*c*) on which work pieces can be moved. The lower plane (22) comprises a plurality of additional openings (22*b*) to facilitate lowering the apparatus into the quenching device.

The frame struts (23) each include two guide means (25), which are fastened above the planes to the latter, whereby the guide means (25) on each frame strut are arranged at the same height. In the exemplary embodiment illustrated in FIG. 1, the guide means (25) are further secured to the frame struts such that in each case two guide means are aligned towards one another, that is to say along one edge of a plane (21, 22). A lifting strut (31) is vertically movably guided in the two guide means (25) of a frame strut (23). In the present exemplary embodiment, the apparatus includes four lifting struts (31), which are connected together at their upper ends with transverse struts. Opposite corners of the rectangle defined by the four transverse struts (32) are connected together by further struts (33), the point of intersection of which is connected to a lifting mechanism (34). In the present exemplary embodiment, only one lifting mechanism is thus used for raising and lowering the lifting struts (31) and the apparatus (1). It is, however, also possible, for instance to associate a separate lifting mechanism with each lifting strut (31)—the individual lifting struts (31) are of course then no longer rigidly connected together.

The upper and the lower planes (21, 22) each have a plurality of openings (21*a*, 22*a*), which extend in the illustrated exemplary embodiment over the entire height of the planes. The openings extend at an angle of 90° from the edge of the planes towards their central axis.

Each of the four lifting struts (31) includes a carrier (35, 36) at a first position associated with the upper plane (21) and at a second position associated with the lower plane (22). The apparatus thus includes four lower (36) and four upper (35) carriers, which are secured to the lifting struts (31) at the same height in each case (and thus define a plane, which is not shown). The carriers are arranged, with respect to an edge of a plane, at an angle of 90° to this edge and extend into the apparatus, whereby two carriers are opposite to one another in each case. In the event of vertical movement of the lifting struts, that is to say relative movement of the lifting struts (31) with respect to the frame structure (20), the carriers (35, 36) move into openings (21*a*, 22*a*), which are formed in the upper and lower planes (21, 22). Due to the mutual alignment of the openings (21*a*, 22*a*) and of the carriers (35, 36), the latter can be moved completely into or through the plane.

In the exemplary embodiment shown in FIG. 1, the guide means (25) act also as stop means, i.e. they limit the relative movement of the lifting struts (31) with respect to the frame structure (20).

The configuration shown in FIG. 1 of the openings and the carriers is only one of many. For instance, the carriers can also be aligned towards the centre of the respective plane. The same applies to the arrangement of the lifting struts with respect to the frame struts. Of importance is that relative movement between the lifting struts and the frame structure is always possible and that the carriers can move in the course of this relative movement into or through the planes.

With regard to the choice of the individual components of the apparatus, it is merely to be noted that they can accommodate the forces which are produced on the one hand and can resist the temperatures which prevail in the immediate vicinity of a rotary hearth furnace, on the other hand. Furthermore, those materials should preferably be used which enable as long maintenance cycles as possible since the maintenance of the apparatus is always associated with a production loss for the rotary hearth furnace.

Individual steps in an exemplary embodiment of the method in accordance with the invention for loading and unloading a thermal treatment furnace will be described below with reference to FIGS. 2*a*-2*e*, in which the workpiece is slid into the heat treatment furnace. The apparatus shown in FIGS. 2*a*-2*e* differ slightly from the apparatus shown in FIG. 1.

Situated below the actual apparatus (1) in accordance with the invention is an oil bath (quenching device) (40) (which is only indicated schematically) with spacer means (41, 61) arranged on its base. Shown in the quenching device (40) is an elevator (60), with which workpieces can be lifted after quenching out of the quenching device.

The apparatus (1) includes four frame struts (23) and four lifting struts (31), which are connected together by means of transverse struts (32). Transverse struts (32) are in turn connected to the lifting mechanism (34). The individual frame struts (23) each include three guide means (25*a*, 25*b*, 25*c*), of which only the guide means (25*b*) act as a stop means and limit the relative movement of the lifting struts (31) with respect to the frame struts (23). Arranged on each of the lifting struts (31) are two carriers (35, 36).

Figure 2A:
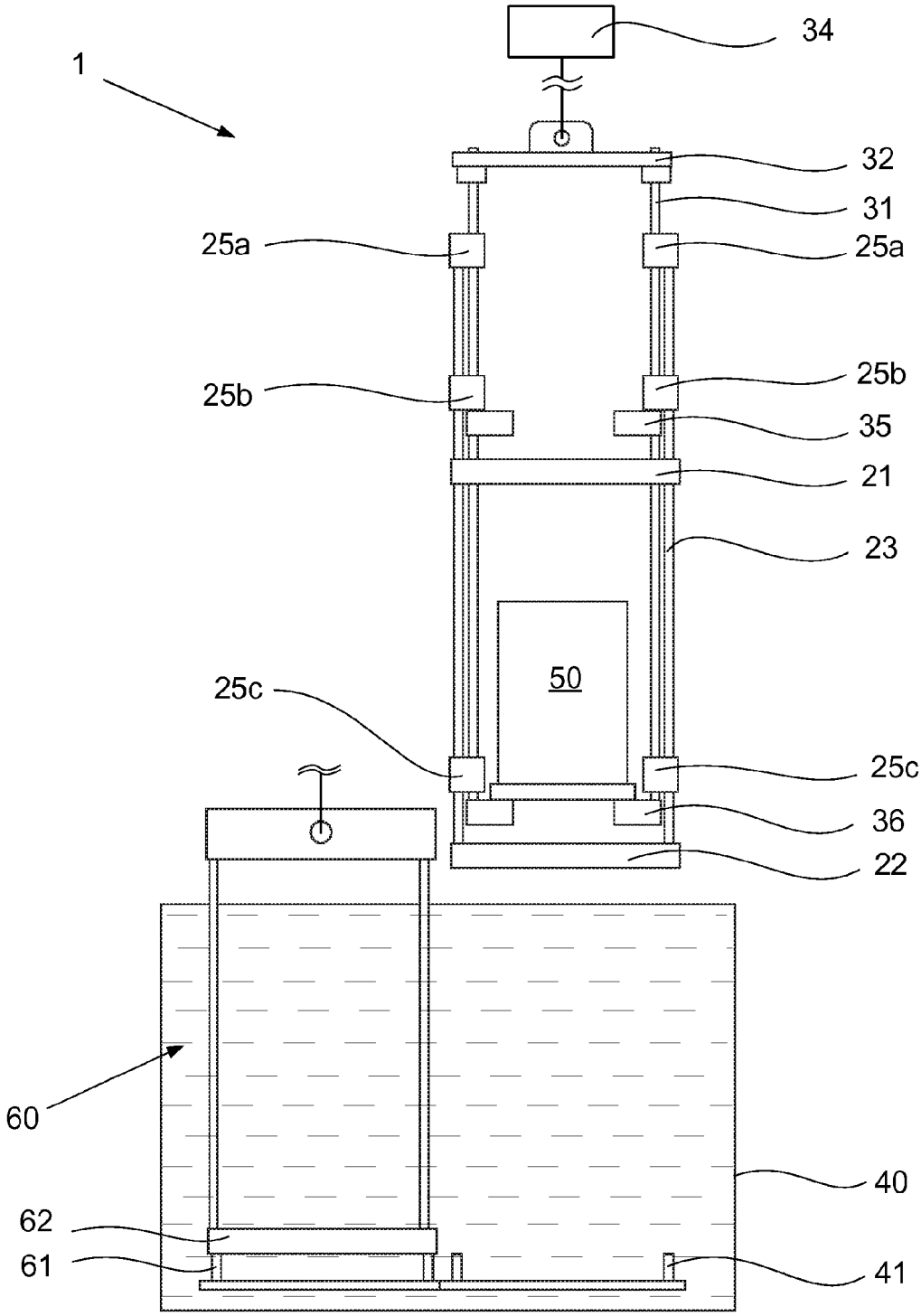
FIGS. 2*a*-2*e* are views of individual method steps of one exemplary embodiment of the method in accordance with the invention.

The apparatus (1) is firstly lifted by means of the lifting struts (31) into a first position, in which a first workpiece (50) from a rotary hearth furnace (not shown) is moved onto the lower carriers (36) (FIG. 2*a*). In this position, the lower carriers (36) are situated approximately at the level of the heat treatment furnace.

The first workpiece (50) can be lowered onto the upper carriers (35) with a lifting/lowering manipulator (not shown). In such an exemplary embodiment, it is no longer necessary to incorporate track bricks in the rotary hearth furnace—the lifting/lowering manipulator moves with appropriate lifting means beneath the first workpiece in the rotary hearth furnace, lifts it, moves the first workpiece out of the rotary hearth furnace and deposits it on the carriers (35).

Figure 2B:
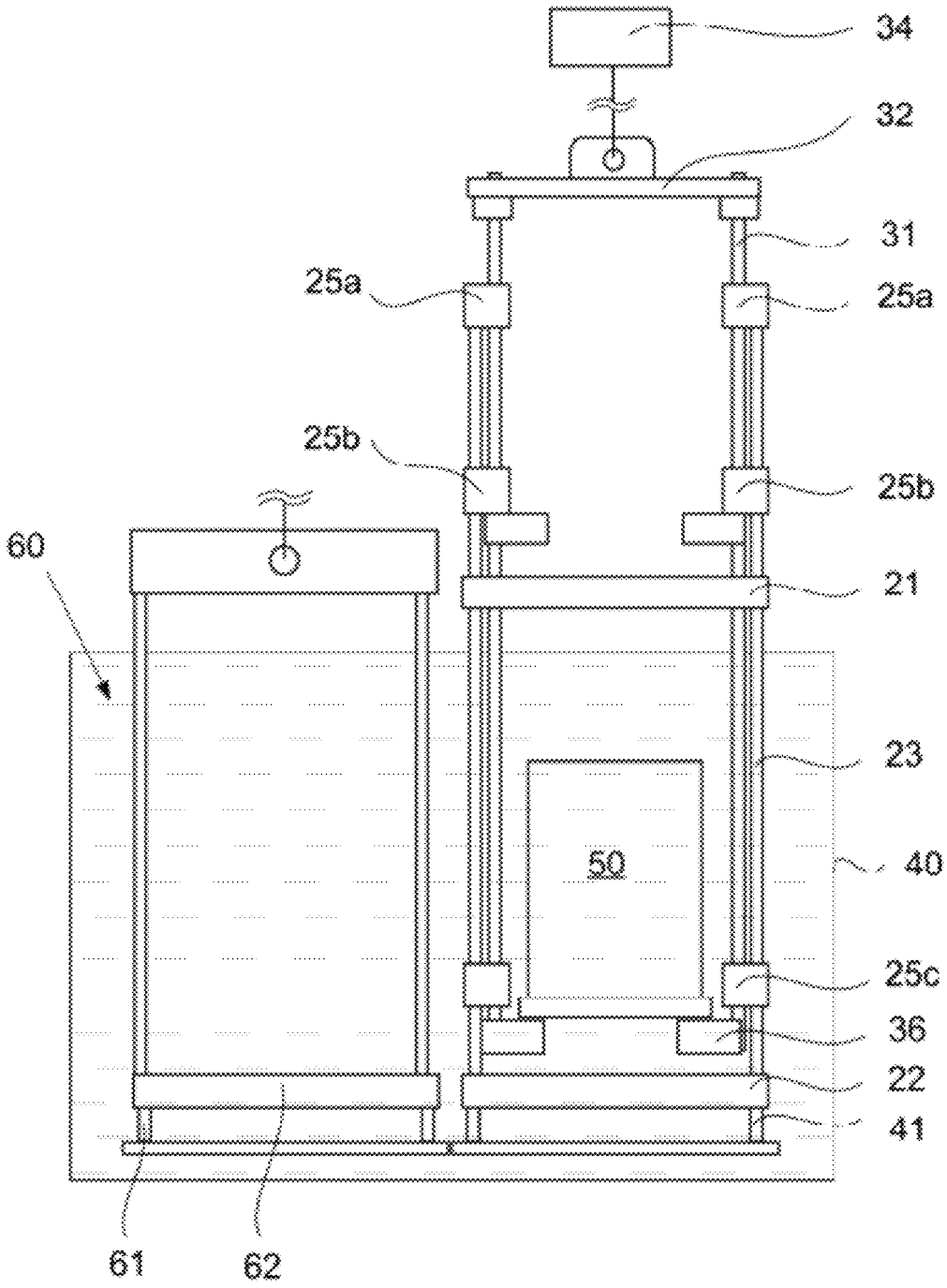
Figure 2C:
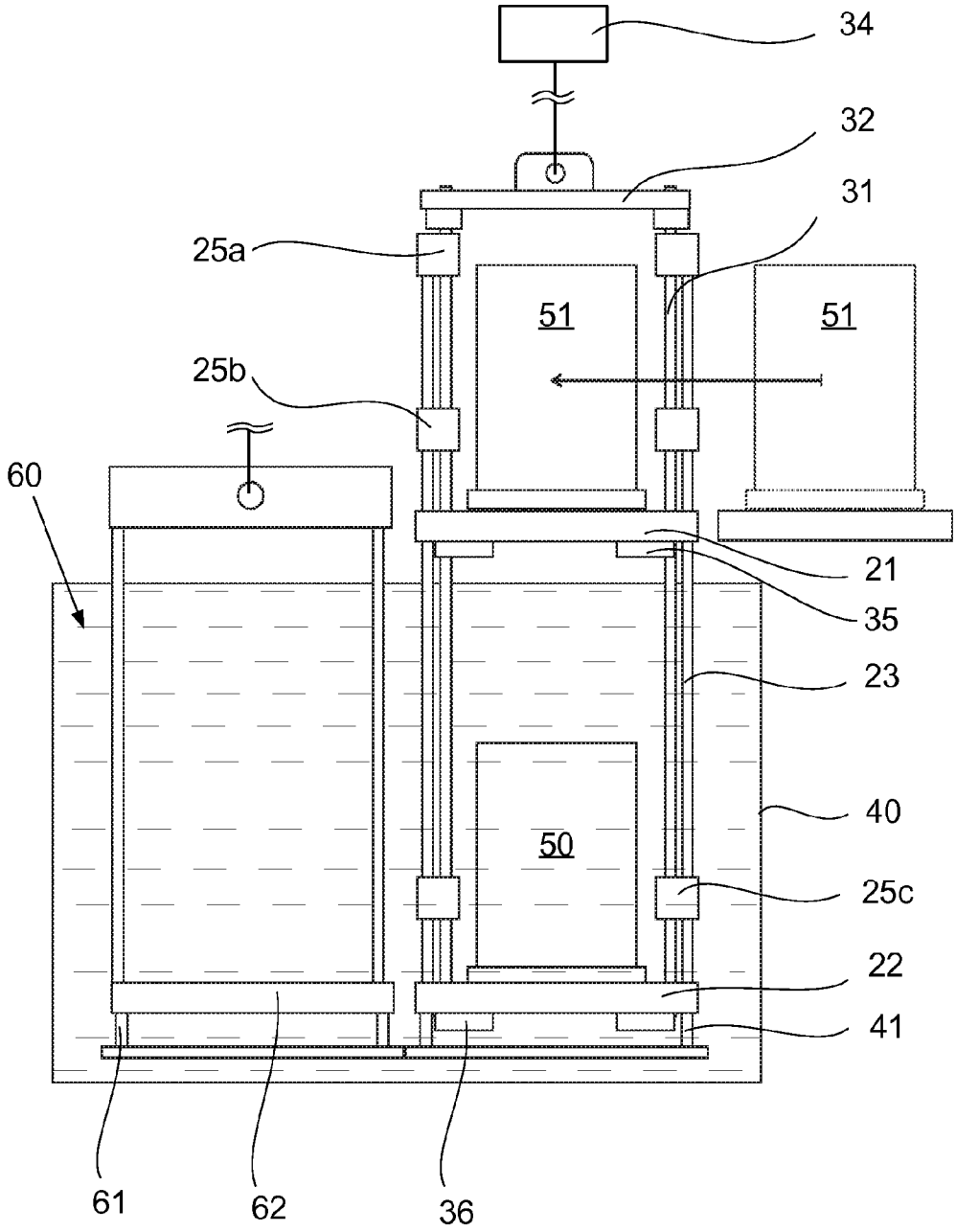

The apparatus is subsequently lowered (FIG. 2*b*) by means of the lifting struts (31) so far into a second position that the lower section of the apparatus, which includes the lower carriers (36) and the lower plane (22), moves into the quenching device or the oil bath (40) and the lower plane (22) is positioned on the spacers (41) (FIG. 2*b*).

In the illustrated exemplary embodiment, the lifting struts (31) are then lowered further continuously into a third position (FIG. 2*c*), whereby the carriers (35, 36) are moved through the openings (21*a*, 22*a*) (not shown) in the planes (21, 22) and whereby the first workpiece (50) is deposited by the lower carriers (36) on the lower plane (22).

As soon as the apparatus has reached this position, a further second workpiece (51) is pushed with a pushing device (not shown) onto the upper plane (21).

Figure 2D:
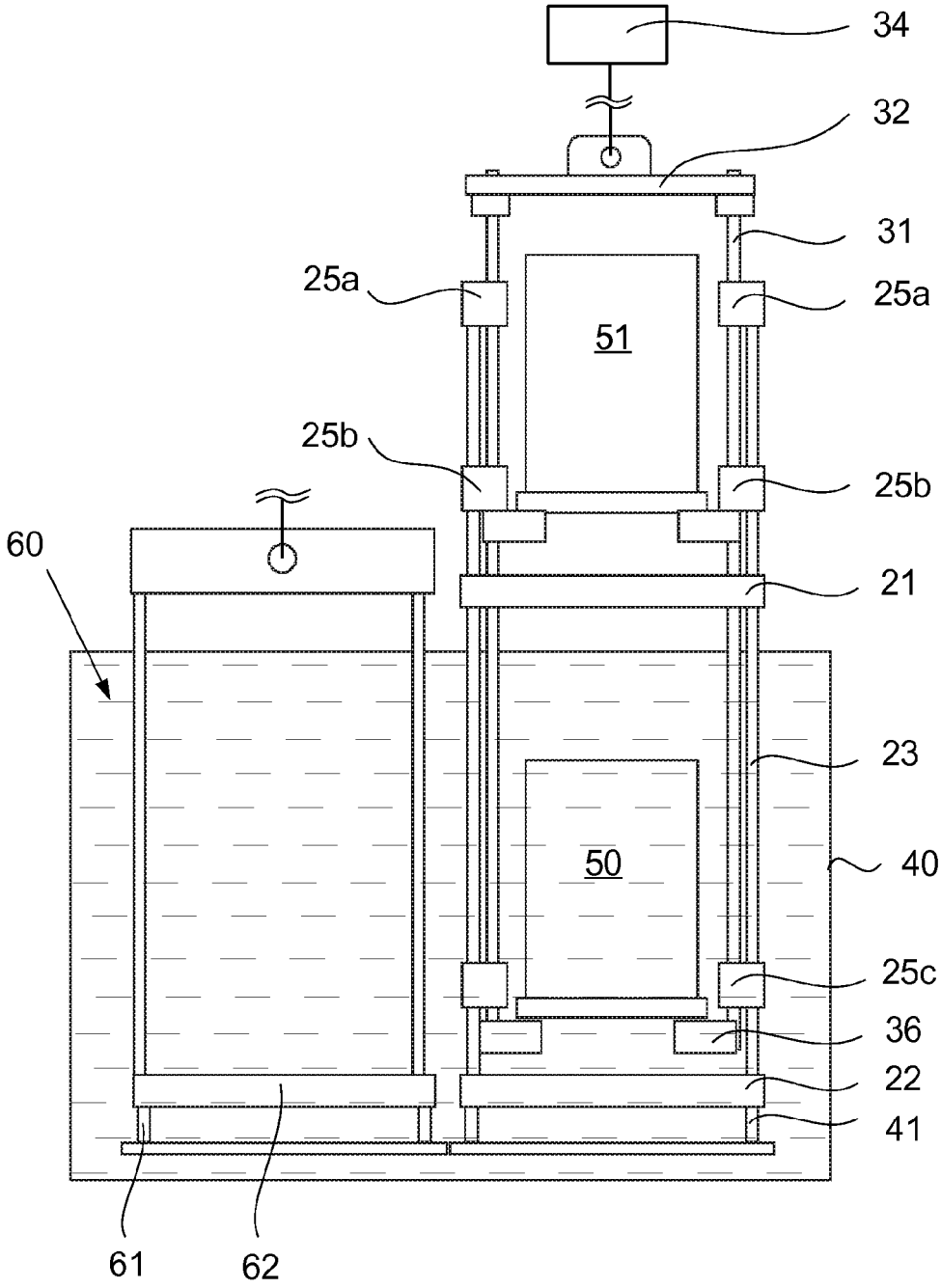

The apparatus is then so lifted by means of the lifting struts (31) that the carriers (35, 36) lift the workpieces (50, 51) from the respective planes (21, 22) (FIG. 2*d*). The second workpiece (51) is then engaged from below by a lifting/lowering manipulator (not shown) and moved into the rotary hearth furnace.

Figure 2E:
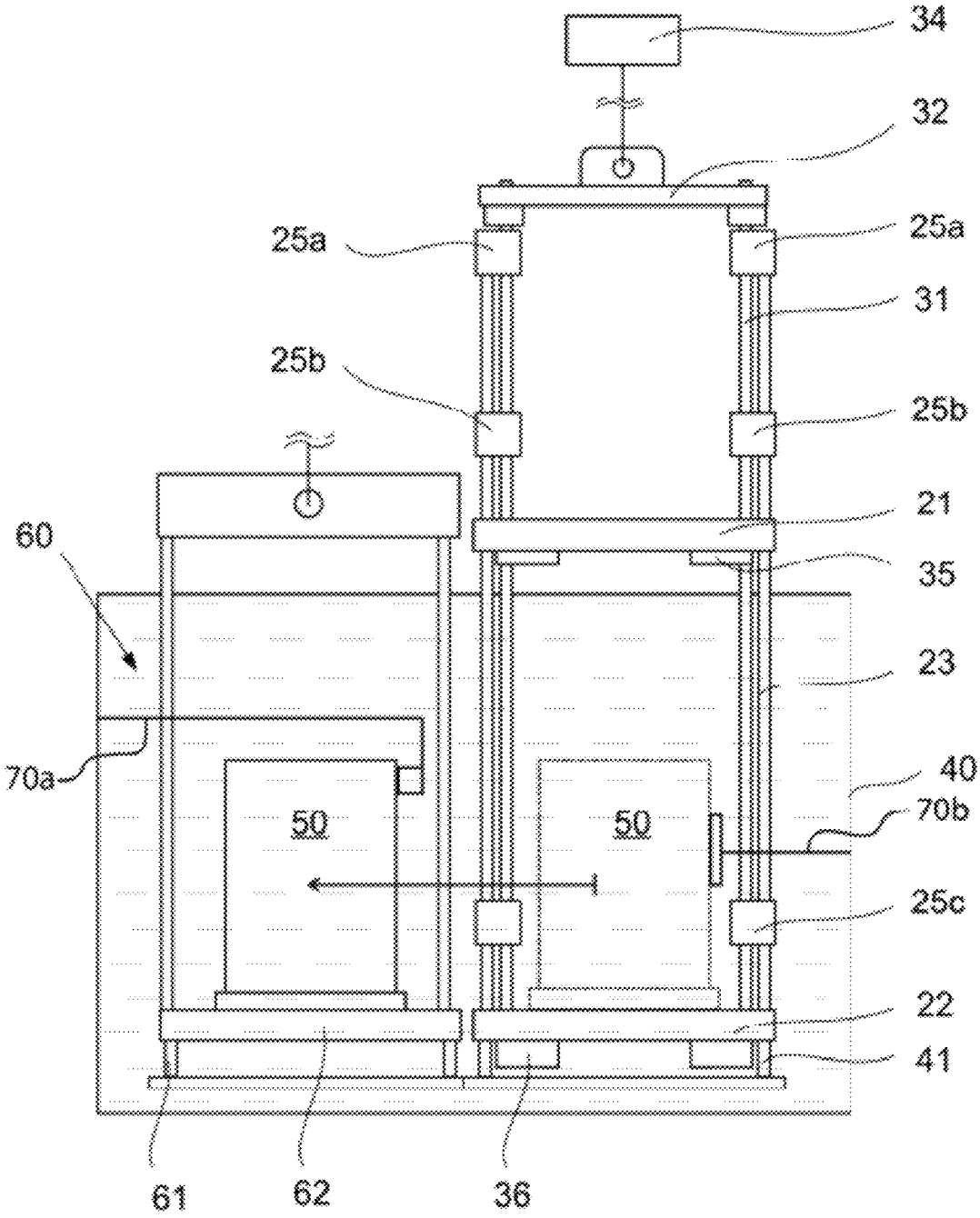

As soon as the second workpiece (51) is moved by the upper carriers (35) into the rotary hearth furnace, the apparatus is lowered by means of the lifting struts (31) so that the carriers (35, 36) move through the planes (21, 22) and the first workpiece (50) is thereby deposited on the lower plane (22) (FIG. 2*e*). The first workpiece (50) is pushed from the lower plane (22) with a pushing device (70*b*) onto a lower plane (62) of the elevator (60), which is situated adjacent the actual apparatus (1) in the oil bath (40). Alternatively, the workpiece (50) can be pulled with a pulling device (70*a*) from the lower plane onto the lower plane (62) of the elevator. The first workpiece (50) is lifted with the elevator out of the oil bath (40) and then supplied to the further processing.

The invention claimed is:

1. An apparatus for loading and unloading a heat treatment furnace including a frame structure with a first upper and a second lower plane, which are arranged parallel above one another and are connected together by a plurality of frame struts, wherein the first and the second planes each have a plurality of openings and wherein the frame struts have a plurality of guides, a plurality of lifting struts, which are connected to a lifting mechanism and are vertically movably mounted in the guides of the frame struts and extend vertically above the upper plane, wherein each lifting strut has a carrier at a first position associated with the upper plane and at a second position associated with the lower plane, wherein the carriers are so aligned on the lifting struts that they are movable into the openings in the associated planes, when a vertical movement of the lifting struts occurs, and at least one stop arranged on a frame strut, which limits the vertical movement of the corresponding lifting strut.

2. The apparatus as claimed in claim 1, wherein slide tracks are arranged on the upper surface of at least one plane.

3. The apparatus as claimed in claim 1, wherein at least the lower plane has additional openings.

4. The apparatus of claim 1, wherein the at least one of the guides is constructed as the at least one stop, which limits the vertical movement of the lifting struts with respect to the frame structure.

5. The apparatus of claim 1, wherein the lifting struts are connected together at their upper end by coupling elements.

6. A method of loading and unloading a thermal treatment furnace with an apparatus and a quenching device arranged beneath the apparatus, comprising:

a) lifting the apparatus by lifting struts into a first position, in which a first workpiece is moved out of a heat treatment furnace onto lower carriers, b) lowering the apparatus by the lifting struts into a second position so that the lower section of the apparatus, which includes the lower carriers and the lower plane, moves into the quenching device and the lower plane is positioned in the quenching device but the carriers remain above the respective plane, c) moving a second workpiece onto an upper support surface, formed by the upper plane or the upper carriers, d) moving the second workpiece from the upper support surface into a rotary hearth furnace, e) lowering the apparatus by the lifting struts into a third position such that the carriers move into the planes and the first workpiece is then deposited from the lower carriers onto the lower plane, and f) removing the first workpiece from the lower plane.

7. The method of claim 6 wherein, in step a), a lifting/lowering manipulator engages beneath the first workpiece in the heat treatment furnace and deposits it on the lower carriers.

8. The method of claim 6 wherein, in step c), the second workpiece is deposited with a lifting/lowering manipulator on the upper carriers, whereby the lifting/lowering manipulator engages beneath the second workpiece during transport onto the upper carriers.

9. The method of claim 6 wherein, in step d), a lifting/lowering manipulator engages beneath the first workpiece and the latter is moved into the heat treatment furnace.

10. The method of claim 6 wherein, in step f), the first workpiece is removed from the lower plane by a pushing or pulling device.

11. The method of claim 6 wherein the lifting struts are further lowered after step b) such that the carriers are moved into the openings in the planes, whereby the first workpiece is positioned by the lower carriers on the lower plane, that in step c) the second workpiece is moved with a pushing or pulling device onto the upper support surface and that the apparatus is subsequently raised by means of the lifting struts such that the carriers lift the workpieces from the respective planes.

* * * * *